US010119299B1

(12) United States Patent
Wu

(10) Patent No.: US 10,119,299 B1
(45) Date of Patent: Nov. 6, 2018

(54) PICKPROOF LOCK

(71) Applicant: Kun-Yu Wu, New Taipei (TW)

(72) Inventor: Kun-Yu Wu, New Taipei (TW)

( * ) Notice: Subject to any disclaimer, the term of this patent is extended or adjusted under 35 U.S.C. 154(b) by 0 days.

(21) Appl. No.: 15/842,666

(22) Filed: Dec. 14, 2017

(51) Int. Cl.
*E05B 27/00* (2006.01)
*E05B 19/00* (2006.01)

(52) U.S. Cl.
CPC ..... *E05B 27/0032* (2013.01); *E05B 27/0003* (2013.01); *E05B 27/0017* (2013.01); *E05B 27/0057* (2013.01); *E05B 19/0047* (2013.01)

(58) Field of Classification Search
CPC ..... E05B 27/0032; E05B 27/0003; E05B 27/0057; E05B 27/0017; E05B 19/0047; E05B 19/0023; E05B 19/0029; E05B 19/0035; E05B 19/14; E05B 27/0021; E05B 27/02; E05B 27/08; E05B 27/083; E05B 27/086
USPC ..... 70/358, 419, 491, 493–496, 401–404, 70/378, 392, 409, 421, DIG. 37
See application file for complete search history.

(56) References Cited

U.S. PATENT DOCUMENTS 2,298,697 A * 10/1942 Hofmann ..... E05B 27/0032 70/395
2,618,957 A * 11/1952 Tonnessen ..... E05B 27/0032 70/358
3,008,322 A * 11/1961 Stackhouse ..... E05B 27/0032 70/395
3,729,964 A * 5/1973 Hsu ..... E05B 27/0032 70/338
4,341,102 A * 7/1982 Ku ..... E05B 27/0042 70/358
4,683,739 A * 8/1987 Hughes ..... E05B 15/1614 70/365
4,838,051 A * 6/1989 Yang ..... E05B 27/086 70/358
5,544,512 A * 8/1996 Shieh ..... E05B 27/083 70/395
6,058,750 A * 5/2000 Li ..... E05B 15/08 70/358
6,584,819 B1 * 7/2003 Hung ..... E05B 27/083 70/358
6,644,078 B1 * 11/2003 Hung ..... E05B 9/086 70/351
8,393,189 B1 * 3/2013 Lin ..... E05B 27/0032 70/356
2004/0231379 A1 * 11/2004 Yu ..... E05B 27/0032 70/491
2006/0016232 A1 * 1/2006 Hung ..... E05B 31/00 70/491

(Continued)

*Primary Examiner* — Lloyd A Gall
(74) *Attorney, Agent, or Firm* — Ming Chow; Sinorica, LLC

(57) ABSTRACT

A pickproof lock has a hollow housing, a lock shaft and a sleeve mounted in the housing, multiple axial pin sets mounted in the lock shaft and the sleeve, and at least one radial pin set mounted in the housing and the lock shaft. When unlocking the pickproof lock, the key is able to push the axial pin sets and the at least one radial pin set to unlocking positions, so as to drive the lock shaft to rotate and to unlock the pickproof lock. The complexity of the pickproof lock is increased. People with bad intentions are unable to unlock the pickproof lock with a lock picking tool, such as a round tube. Accordingly, personal goods or private matters can be safely protected by the pickproof lock.

3 Claims, 5 Drawing Sheets

(56) References Cited

U.S. PATENT DOCUMENTS

2006/0096344 A1* 5/2006 Lee ..... E05B 27/0032
70/491

* cited by examiner

PICKPROOF LOCK

BACKGROUND OF THE INVENTION

1. Field of the Invention

The present invention relates to a lock, especially to a pickproof lock that can be avoided from being opened by a lock picking tool.

2. Description of the Prior Art(s)

A lock is commonly used to protect personal goods or private matters and only a specific key may unlock the lock, so as to avoid the personal goods and the private matters from being stolen.

A conventional lock comprises a hollow housing, a lock shaft and a sleeve mounted in the housing, and multiple pin sets mounted in the lock shaft and the sleeve. The pin sets are separately arranged annularly. Each of the pin sets includes two pins and a resilient element. The two pins and the resilient element are arranged along an axial direction of the housing. When a key is inserted into the lock, the key pushes the pins and compresses the resilient elements. As a gap between the pins of each of the pin sets aligns with a shear plane between the lock shaft and the sleeve, the key can be turned to drive the lock shaft to rotate, such that the conventional lock is unlocked.

By understanding the above-mentioned details of unlocking the conventional lock, a person with bad intentions may insert a round tube into the housing, letting an outer surface of the round tube be damaged by the pins and letting multiple slots with different lengths be formed on the outer surface of the round tube. According to the lengths of the slots, distances that the pin sets should be pushed when unlocking the lock can be speculated. The person with bad intentions can illegally unlock the lock by using the round tube having the slots and steal the personal goods or private matters. Therefore, the conventional lock is unable to avoid the personal goods and the private matters from being stolen.

To overcome the shortcomings, the present invention provides a pickproof lock to mitigate or obviate the aforementioned problems.

SUMMARY OF THE INVENTION

The main objective of the present invention is to provide pickproof lock that has a housing, a lock shaft, a sleeve, multiple axial pin sets, and at least one radial pin set.

The housing has a mounting chamber defined in the housing, a sidewall defined around the mounting chamber, and at least one through hole. Each of the at least one through hole is formed through the sidewall of the housing.

The lock shaft is mounted in the mounting chamber of the housing and has a head portion, a mounting portion axially protruding from a rear end surface of the head portion, an outer recess axially formed in a front end surface of the head portion, an inner recess axially formed in a inner bottom in the outer recess, multiple mounting holes separately arranged annularly along a peripheral side surface of the head portion, at least one side hole, at least one inner side surface, and at least one stop flange. Each of the at least one side hole is formed in the peripheral side surface of the head portion and aligns with a corresponding one of the at least one through hole of the housing. Each of the at least one inner side surface of the lock shaft is defined around a corresponding one of the at least one side hole. Each of the at least one stop flange is formed on a corresponding one of the at least one inner side surface of the lock shaft.

The sleeve is mounted around the mounting portion of the lock shaft, is securely connected with the housing, and has multiple blind holes formed in a front end surface of the sleeve and respectively aligning with the mounting holes of the lock shaft.

The axial pin sets are respectively mounted in the mounting holes of the lock shaft and are respectively mounted in the blind holes of the sleeve. Each of the axial pin sets includes a first pin, an axial resilient element, and a second pin.

The at least one radial pin set is mounted in the at least one side hole of the lock shaft and the at least one through hole of the housing. Each of the at least one radial pin set includes a key pin, a driver pin, a retaining panel, and a radial resilient element.

When unlocking the pickproof lock, the key is able to push the axial pin sets and the at least one radial pin set to unlocking positions, so as to drive the lock shaft to rotate and to unlock the pickproof lock. The complexity of the pickproof lock is increased. People with bad intentions are unable to unlock the pickproof lock with a lock picking tool, such as a round tube. Accordingly, personal goods or private matters can be safely protected by the pickproof lock. Other objectives, advantages and novel features of the invention will become more apparent from the following detailed description when taken in conjunction with the accompanying drawings.

DETAILED DESCRIPTION OF THE PREFERRED EMBODIMENTS

Figure 1:
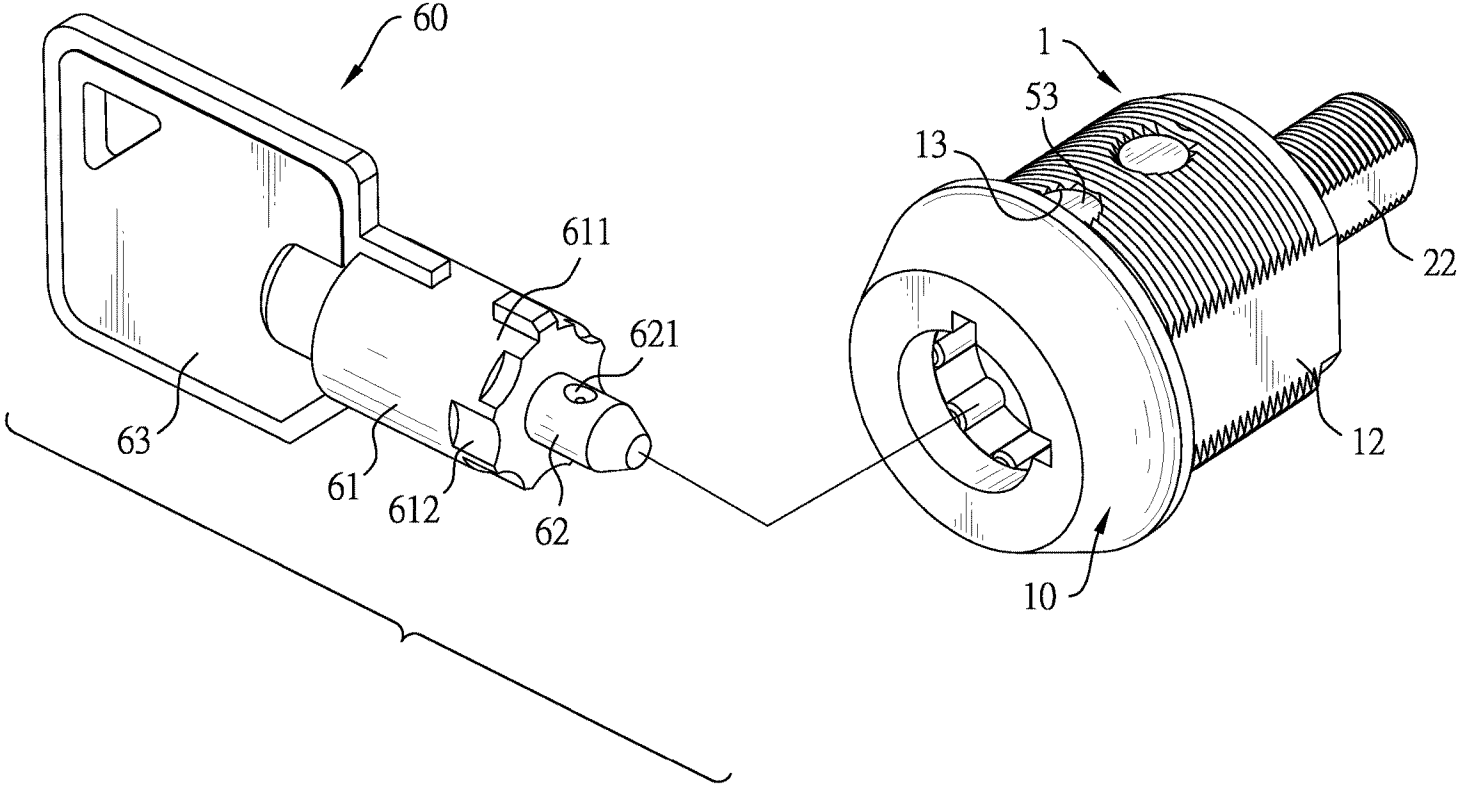
FIG. 1 is a perspective view of a pickproof lock in accordance with the present invention and a key for the pickproof lock.

FIG. 1 shows a pickproof lock 1 in accordance with the present invention and a key for the pickproof lock 60.

Figure 2:
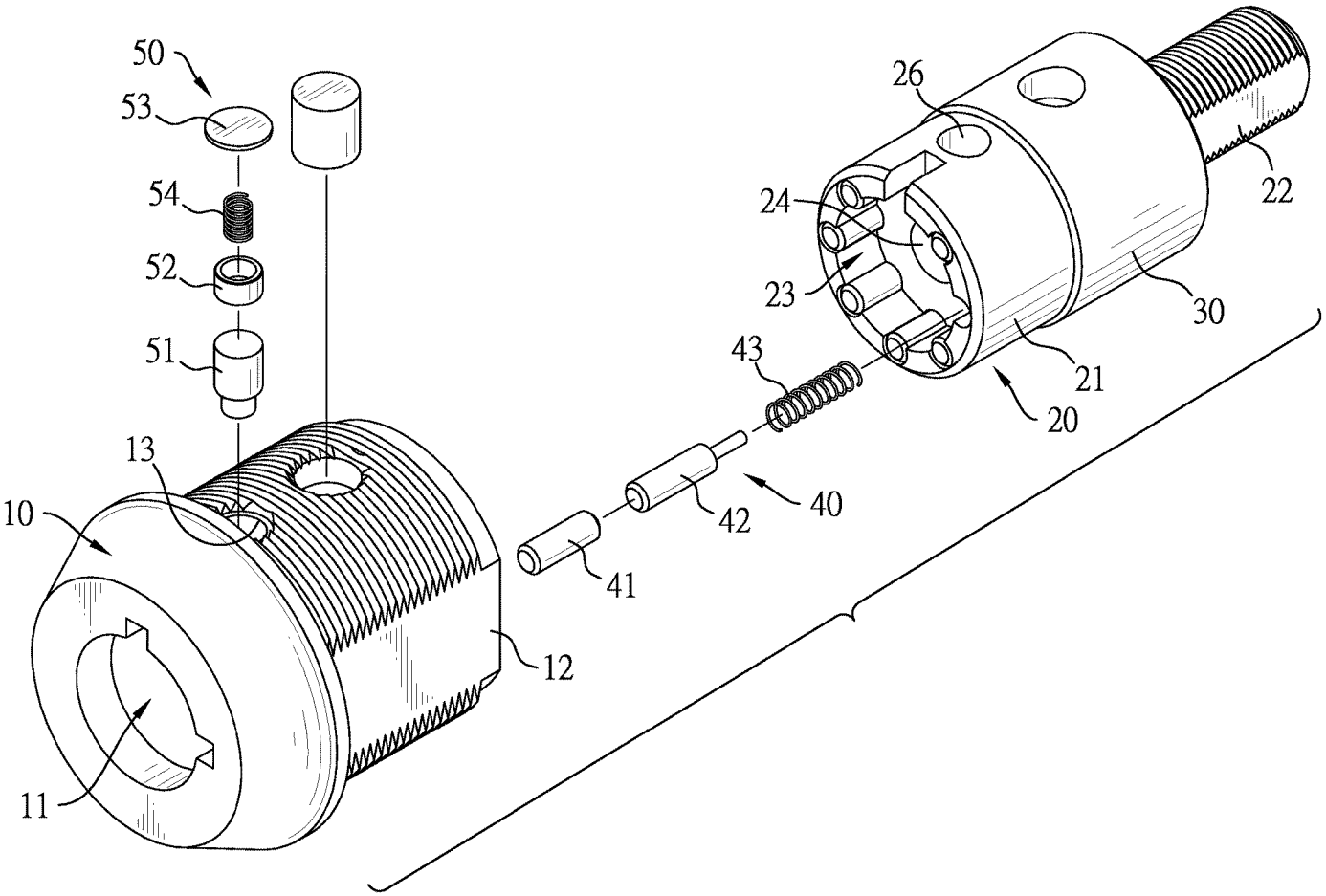
FIG. 2 is an exploded perspective view of the pickproof lock in FIG. 1.
Figure 3:
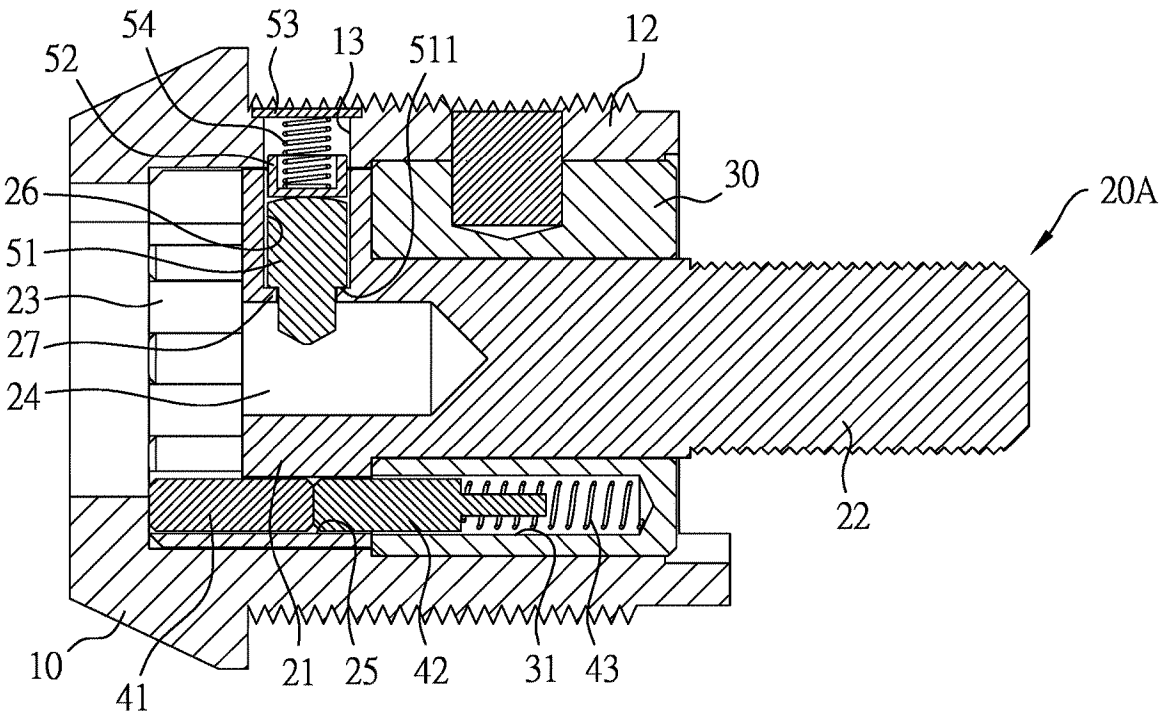
FIG. 3 is a cross-sectional side view of the pickproof lock in FIG. 1.

With further reference to FIGS. 2 and 3, the pickproof lock 1 comprises a housing 10, a lock shaft 20, a sleeve 30, multiple axial pin sets 40, and at least one radial pin set 50.

The housing 10 has a front end, a rear end, a mounting chamber 11, a sidewall 12, and at least one through hole 13. The rear end of the housing 10 is disposed opposite to the front end of the housing 10. The mounting chamber 11 is defined in the housing 10 and is formed through the front end of the housing 10 and the rear end of the housing 10. The sidewall 12 of the housing 10 is defined around the mounting chamber 11. Each of the at least one through hole 13 is formed through the sidewall 12 of the housing 10.

The lock shaft 20 is mounted in the mounting chamber 11 of the housing 10 and has a head portion 21, a mounting portion 22, an outer recess 23, an inner recess 24, multiple mounting holes 25, at least one side hole 26, at least one inner side surface, and at least one stop flange 27.

The head portion 21 has a peripheral side surface, a front end surface, a rear end surface. The front end surface of the head portion 21 faces the front end of the housing 10. The rear end surface of the head portion 21 faces the rear end of the housing 10. The mounting portion 22 axially protrudes from the rear end surface of the head portion 21, protrudes out of the housing 10 from the rear end of the housing 10, and may be attached to a latch. A diameter of the mounting portion 22 is smaller than a diameter of the head portion 21.

The outer recess 23 is axially formed in the front end surface of the head portion 21. An inner bottom is defined in the outer recess 23 and is parallel to the front end surface of the head portion 21 and rear end surface of the head portion 21. The inner recess 24 axially formed in the inner bottom in the outer recess 23 and extends into the mounting portion 22.

The mounting holes 25 separately arranged annularly along the peripheral side surface of the head portion 21. Each of the mounting holes 25 is axially formed through the front end surface of the head portion 21 and the rear end surface of the head portion 21. Each of the at least one side hole 26 is formed in the peripheral side surface of the head portion 21, radially extends in the head portion 21, communicates with the inner recess 24, and aligns with a corresponding one of the at least one through hole 13 of the housing 10.

Each of the at least one inner side surface of the lock shaft 20 is defined around a corresponding one of the at least one side hole 26. Each of the at least one stop flange 27 is formed on a corresponding one of the at least one inner side surface of the lock shaft 20 and is disposed adjacent to the inner recess 24.

The sleeve 30 is cylindrical and is annular in cross-section. The sleeve 30 is mounted around the mounting portion 22 of the lock shaft 20, is disposed in the mounting chamber 11, is securely connected with the housing 10, and has a front end surface and multiple blind holes 31. The front end surface of the sleeve 30 is annular and faces the rear end surface of the head portion 21 of the lock shaft 20. The blind holes 31 are formed in the front end surface of the sleeve 30, are separately arranged annularly, and respectively align with the mounting holes 25 of the lock shaft 20.

The axial pin sets 40 are respectively mounted in the mounting holes 25 of the lock shaft 20 and are respectively mounted in the blind holes 31 of the sleeve 30. Each of the axial pin sets 40 includes a first pin 41, an axial resilient element 43, and a second pin 42. The first pin 41 is mounted in the mounting hole 25 of the lock shaft 20. The axial resilient element 43 is mounted in the blind hole 31 of the sleeve 30. Specifically, the axial resilient element 43 is a compression spring. The second pin 42 is mounted in the blind hole 31 of the sleeve 30 and is disposed between the first pin 41 and the axial resilient element 43. The second pin 42 is pushed by the axial resilient element 43 to protrude to the mounting hole 25 of the lock shaft 20 and abut against the first pin 41.

The at least one radial pin set 50 is mounted in the at least one side hole 26 of the lock shaft 20 and the at least one through hole 13 of the housing 10. Each of the at least one radial pin set 50 includes a key pin 51, a driver pin 52, a retaining panel 53, and a radial resilient element 54.

The key pin 51 is mounted in the side hole 26 of the lock shaft 20 and has a positioning end, an abutting end, a side surface, and an abutting flange 511. The positioning end of the key pin 51 protrudes to the inner recess 24 of the lock shaft 20. The abutting end of the key pin 51 is disposed opposite to the positioning end of the key pin 51. The abutting flange 511 is formed around the side surface of the key pin 51, is disposed between the positioning end and the abutting end of the key pin 51, and abuts the stop flange 27 in the side hole 26 of the lock shaft 20. The driver pin 52 is mounted in the side hole 26 of the lock shaft 20 and the through hole 13 of the housing 10 and abuts the abutting end of the key pin 51.

The retaining panel 53 is mounted in the through hole 13 of the housing 10 and is securely attached to the housing 10. The radial resilient element 54 is mounted in the through hole 13 of the housing 10, is disposed between the driver pin 52 and the retaining panel 53, and has two ends respectively abutting the driver pin 52 and the retaining panel 53 to push the driver pin 52 to protrude to the side hole 26 of the lock shaft 20. Specifically, the radial resilient element 51 is a compression spring.

As shown in FIG. 1, the key 60 for the pickproof lock 1 has a handle 63, a first unlocking cylinder 61, and a second unlocking cylinder 62. The handle 63 allows the key 60 to be held. The first unlocking cylinder 61 protrudes from an end of the handle 63 and has a side surface, a connecting end, an insertion end 611, and multiple slots 612. The connecting end is attached to the handle 63. The insertion end 611 is disposed opposite to the connecting end. The slot 612 are formed in the side surface of the first unlocking cylinder 61, are arrange around the insertion end 611 of the first unlocking cylinder 61. Each of the slots 612 axially extends and is formed through an end surface of the insertion end 611. The second unlocking cylinder 62 axially protrudes from the end surface of the insertion end 611 of the first unlocking cylinder 61 and has a side surface and at least one indentation 621. The at least one indentation 621 is formed in the side surface of the second unlocking cylinder 62.

Figure 4:
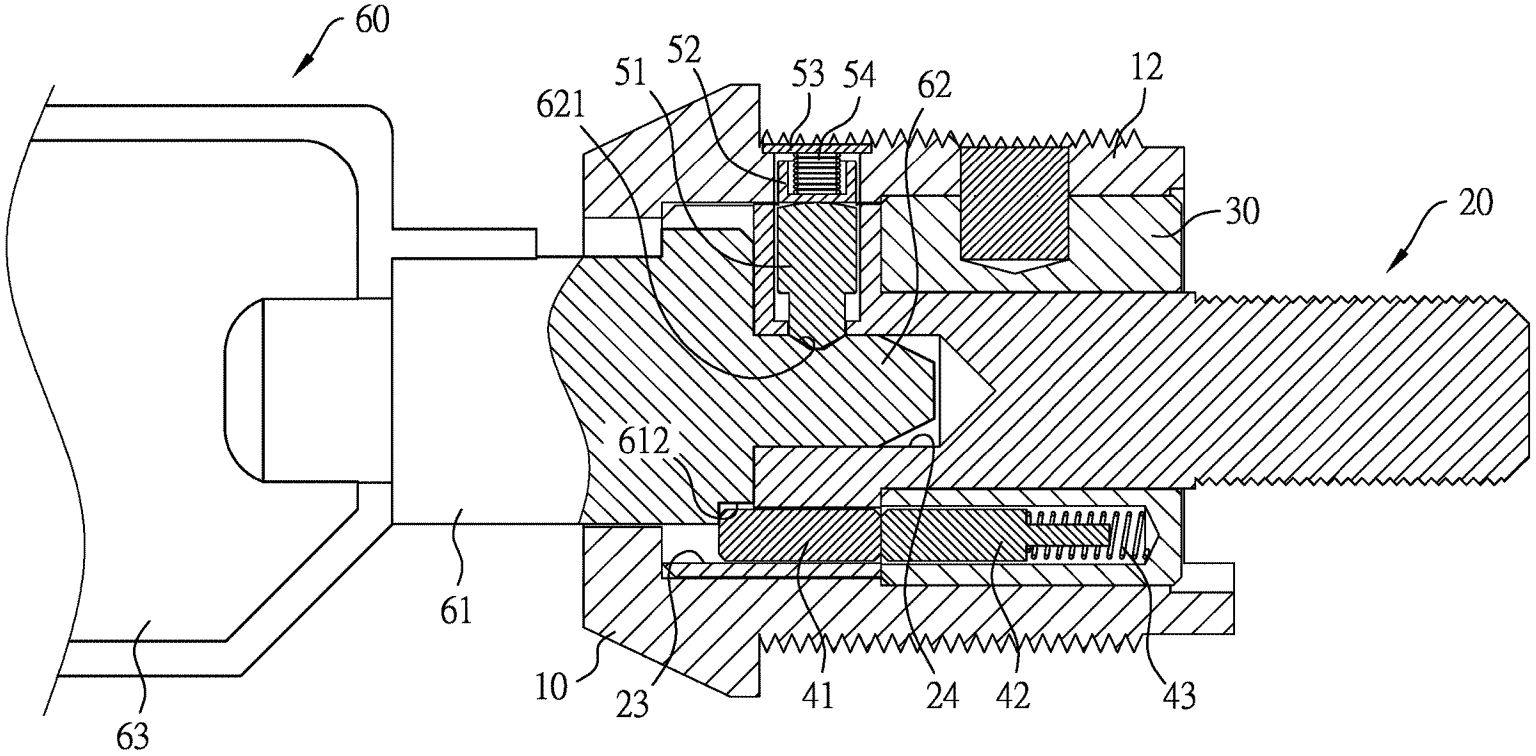
FIG. 4 is an operational cross-sectional side view of the pickproof lock in FIG. 1, showing that the key is inserted into the pickproof lock.

With further reference to FIG. 4, when the first unlocking cylinder 61 and the second unlocking cylinder 62 of the key 60 are inserted into the pickproof lock 1 from the front end of the housing 10, the second unlocking cylinder 62 protrudes into the inner recess 24 of the lock shaft 20 and the first unlocking cylinder 61 protrudes into the outer recess 23 of the lock shaft 20. The key pin 51 of each of the at least one radial pin set 50 is pushed by the second unlocking cylinder 62, protrudes in a corresponding one of the at least one indentation 621, and abuts the second unlocking cylinder 62. Accordingly, the key pin 51 slides into the side hole 26 of the lock shaft 20, the driver pin 62 slides into the through hole 13 of the housing 10, and the radial resilient element 54 is compressed. The first pin 41 of each of the axial pin sets 40 protrudes in a corresponding one of the slots 612 of the first unlocking cylinder 61 and is pushed by the first unlocking cylinder 61. Accordingly, the first pin 41 slides into the mounting hole 25 of the lock shaft 20, the second pin 42 slides into the blind hole 31 of the sleeve 30, and the axial resilient element 43 in compressed.

As a gap between the key pin 51 and the driver pin 52 of each of the at least one radial pin set 50 aligns with a shear plane between the head portion 21 of the lock shaft 20 and the sidewall 12 of the housing 10 and a gap between the first pin 41 and the second pin 42 of each of the axial pin sets 40 aligns with a shear plane between the head portion 21 of the lock shaft 20 and the sleeve 30, the key 60 can be turned to drive the lock shaft 20 to rotate and to unlock the pickproof lock 1.

As shown in FIG. 3, in a preferred embodiment of the pickproof lock 1, the at least one through hole 13 of the housing 10 includes one through hole 13, the at least one side hole 26 of the lock shaft 20 includes one side hole 26, and the at least one radial pin set 50 includes one radial pin set 50. The side hole 26 of the lock shaft 20 aligns with and communicates with the through hole 13 of the housing 10. The radial pin set 50 is mounted in the side hole 26 of the lock shaft 20 and the through hole 13 of the housing 10. Accordingly, the at least one indentation 621 of the second unlocking cylinder 62 of the key 60 includes one indentation 621, so as to allow the key pin 51 of the radial pin set 50 to protrude into the indentation 621.

Figure 5:
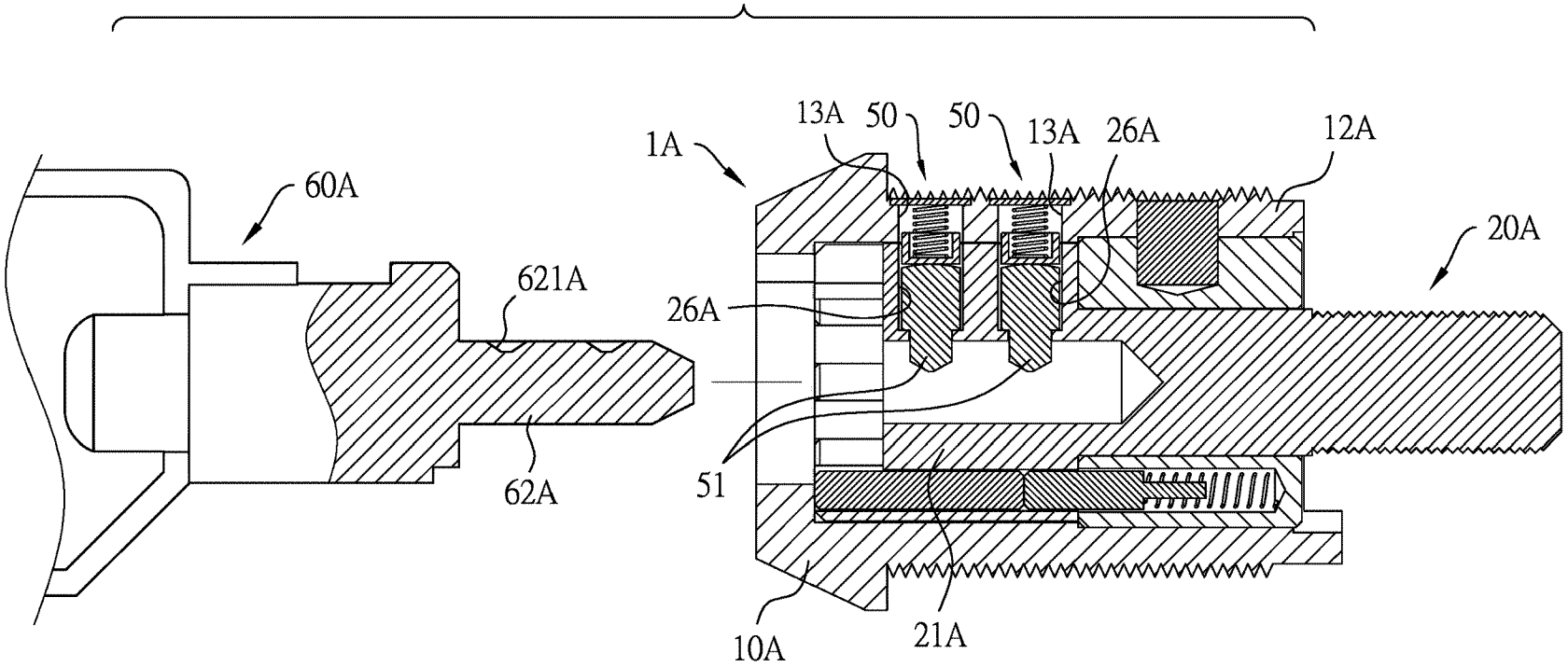
FIG. 5 is a cross-sectional side view of another embodiment of a pickproof lock in accordance with the present invention and a key for the pickproof lock.

Furthermore, with further reference to FIG. 5, in another preferred embodiment of the pickproof lock 1A, the at least one through hole 13A of the housing 10A includes multiple through holes 13A separately arranged axially along the housing 10A, the at least one side hole 26A of the lock shaft 20A includes multiple side holes 26 separately arranged along the head portion 21A of the lock shaft 20A and respectively corresponding in position to the through holes 13A of the housing 10A, and the at least one radial pin set 50 includes multiple radial pin sets 50 respectively mounted in the side holes 26A of the lock shaft 20A and respectively mounted in the through holes 13A of the housing 10A. Accordingly, the at least one indentation 621A of the second unlocking cylinder 62A of the key 60A includes multiple indentation 621A, so as to allow the key pin 51 of the radial pin sets 50 to protrude into the indentation 621A. By increasing numbers of the radial pin sets 50, complexity of the pickproof lock 1A can be increased.

The pickproof lock 1, 1A as described has the following advantages. Since the pickproof 1, 1A comprises both the axial pin sets 40 and the at least one radial pin set 50, when unlocking the pickproof lock 1, 1A, the key 60, 60A is able to push the axial pin sets 40 and the at least one radial pin set 50 to unlocking positions, so as to drive the lock shaft 20, 20A and the latch to rotate and to unlock the pickproof lock 1, 1A. Thus, the complexity of the pickproof lock 1, 1A is increased. People with bad intentions are unable to unlock the pickproof lock 1, 1A with a lock picking tool, such as a round tube. Accordingly, personal goods or private matters can be safely protected by the pickproof lock 1, 1A.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pickproof lock comprising:

a housing having a mounting chamber defined in the housing and formed through a front end of the housing and a rear end of the housing;

a sidewall defined around the mounting chamber; and at least one through hole, and each of the at least one through hole formed through the sidewall of the housing;

a lock shaft mounted in the mounting chamber of the housing and having a head portion;

a mounting portion axially protruding from a rear end surface of the head portion;

an outer recess axially formed in a front end surface of the head portion, wherein an inner bottom is defined in the outer recess;

an inner recess axially formed in the inner bottom in the outer recess;

multiple mounting holes separately arranged annularly along a peripheral side surface of the head portion, and each of the mounting holes axially formed through the front end surface of the head portion and the rear end surface of the head portion;

at least one side hole, and each of the at least one side hole formed in the peripheral side surface of the head portion, radially extending in the head portion, communicating with the inner recess, and aligning with a corresponding one of the at least one through hole of the housing;

at least one inner side surface, and each of the at least one inner side surface of the lock shaft defined around a corresponding one of the at least one side hole; and at least one stop flange, and each of the at least one stop flange formed on a corresponding one of the at least one inner side surface of the lock shaft;

a sleeve mounted around the mounting portion of the lock shaft, disposed in the mounting chamber, securely connected with the housing, and having multiple blind holes, and the blind holes formed in a front end surface of the sleeve, separately arranged annularly, and respectively aligning with the mounting holes of the lock shaft;

multiple axial pin sets respectively mounted in the mounting holes of the lock shaft and respectively mounted in the blind holes of the sleeve, and each of the axial pin sets including a first pin mounted in the mounting hole of the lock shaft;

an axial resilient element mounted in the blind hole of the sleeve; and a second pin mounted in the blind hole of the sleeve, disposed between the first pin and the axial resilient element, pushed by the axial resilient element to protrude to the mounting hole of the lock shaft and abut against the first pin; and at least one radial pin set mounted in the at least one side hole of the lock shaft and the at least one through hole of the housing, and each of the at least one radial pin set including a key pin mounted in the side hole of the lock shaft and having a positioning end protruding to the inner recess of the lock shaft;

an abutting end disposed opposite to the positioning end of the key pin; and an abutting flange formed around a side surface of the key pin, disposed between the positioning end and the abutting end of the key pin, and abutting the stop flange in the side hole of the lock shaft;

a driver pin mounted in the side hole of the lock shaft and the through hole of the housing and abutting the abutting end of the key pin;

a retaining panel mounted in the through hole of the housing and securely attached to the housing; and a radial resilient element mounted in the through hole of the housing, disposed between the driver pin and the retaining panel, and having two ends respectively abutting the driver pin and the retaining panel to push the driver pin to protrude to the side hole of the lock shaft.

2. The pickproof lock as claimed in claim 1, wherein the at least one through hole of the housing includes one through hole;

the at least one side hole of the lock shaft includes one side hole aligning with and communicating with the through hole of the housing; and the at least one radial pin set includes one radial pin set mounted in the side hole of the lock shaft and the through hole of the housing.

3. The pickproof lock as claimed in claim 1, wherein the at least one through hole of the housing includes multiple through holes separately arranged axially along the housing;

the at least one side hole of the lock shaft includes multiple side holes separately arranged along the head portion of the lock shaft and respectively corresponding in position to the through holes of the housing; and the at least one radial pin set includes multiple radial pin sets respectively mounted in the side holes of the lock shaft and respectively mounted in the through holes of the housing.

* * * * *